US006921032B2

(12) United States Patent
Habermacher et al.

(10) Patent No.: US 6,921,032 B2
(45) Date of Patent: Jul. 26, 2005

(54) SPRAYER, IN PARTICULAR, A DISHWASHING SPRAYER

(75) Inventors: Joe Habermacher, Reinach (CH); Johannes Würgler, Meisterschwanden (CH)

(73) Assignee: KWC AG, Unterkulm (CH)

( * ) Notice: Subject to any disclaimer, the term of this patent is extended or adjusted under 35 U.S.C. 154(b) by 0 days.

(21) Appl. No.: 10/806,134

(22) Filed: Mar. 23, 2004

(65) Prior Publication Data

US 2004/0188549 A1 Sep. 30, 2004

(30) Foreign Application Priority Data

Mar. 24, 2003 (EP) ..... 03006530

(51) Int. Cl.[7] ..... B05B 7/02; B05B 9/01
(52) U.S. Cl. ..... 239/525; 239/526
(58) Field of Search ..... 239/525, 526, 239/569, 587.5, 587.6, 602, DIG. 12

(56) References Cited

U.S. PATENT DOCUMENTS 5,732,884 A 3/1998 Jauner

FOREIGN PATENT DOCUMENTS

| | | |
|---|---|---|
| CH | A-647 165 | 1/1985 |
| EP | A-0 088 739 | 9/1983 |
| EP | A-0 656 503 | 6/1995 |
| EP | A-0 704 252 | 4/1996 |

*Primary Examiner*—David A. Scherbel
*Assistant Examiner*—Darren Gorman
(74) *Attorney, Agent, or Firm*—Oliff & Berridge, PLC

(57) ABSTRACT

The sprayer has, in the interior of the handle, a flow channel, in which the cylinder element is arranged. The piston is mounted in a freely displaceable manner in the cylinder element, and the cylinder element is open on the end side in the direction of the shut-off valve. The cylinder element and the piston bound, for example, an air-filled gas volume. If pressure surges occur when the shut-off valve is closed quickly, these pressure surges are damped by the piston moving in the direction of the cylinder bottom and compressing the gas in the gas volume in the process.

10 Claims, 3 Drawing Sheets

SPRAYER, IN PARTICULAR, A DISHWASHING SPRAYER

CROSS-REFERENCE TO RELATED APPLICATION

The disclosure of European Patent Application No. 03 006 530.4 filed on Mar. 24, 2003 including the specification, drawings and claims is incorporated herein by reference in its entirety.

BACKGROUND OF THE INVENTION

1. Field of Invention

The present invention relates to a sprayer, in particular, a dishwashing sprayer.

2. Description of Related Art

A sprayer of this type is known, for example, from EP-A-0 656 503. It has a tubular handle which bears, at its inlet end, a connection nipple for a supply hose and, at its outlet end, a spray head and a shut-off valve. The shut-off valve can be actuated by means of a hand lever counter to the force of a restoring spring which is intended for closing purposes. Within the handle, an inner tube extends from the connection nipple to the shut-off valve. This tube is enclosed by an elastomeric hose and has spaced-apart openings into the interior of the hose. Rapid closure of the shut-off valve produces a temporary positive pressure as a result of the water column of the water fed being slowed down too rapidly. In order to damp this pressure surge in the supply line with its adverse effects, use is made of the inner tube with the hose fitted over it, the latter temporarily expanding, as a compliant wall, into a cavity in the handle.

A further sprayer with a damping system for pressure surges which is based on the same principle is known from EP-A-0 704 252 and corresponding U.S. Pat. No. 5,732,884.

During closure of the shut-off valve, the resulting pressure surge moves from the shut-off valve, through the inner tube, in the direction of the connection nipple. During this movement, the pressure surge reaches the openings one after the other, which results in the pressure surge being damped in a step-like manner until it has reached the connection nipple.

In order to prevent or reduce pressure surges, it is also known, from CH-A-647 165, to allow the shut-off valve of a dishwashing sprayer to close in a delayed manner even when the hand lever is rapidly released. A valve piston which is spring-loaded in the closing direction of the shut-off valve, and is operatively connected to the latter, is guided in a cage and has a connecting channel, which acts as a restrictor, running through it. By means of the connecting channel, a cage chamber which is bounded by the cage and the valve piston is connected to the flow channel for the water, which is bounded by a cylinder tube arranged in the interior of the handle. As a result of the restricting action of the connecting channel, it is only possible for a limited quantity of water per unit of time to flow into the cage chamber and/or to be displaced out of the latter. This limits the speed at which the shut-off valve can be opened and closed.

SUMMARY OF THE INVENTION

It is an object of the present invention to provide a sprayer of the generic type which, along with a straightforward construction, has optimum damping behavior for pressure surges.

This object is achieved by a sprayer of the invention which has the features described herein.

Arranged in the interior of a flow channel, according to the invention, is a cylinder element, in which a gas volume for damping the pressure surges is located. Since the cylinder element is open in its end region which is directed toward the shut-off element, the corresponding, entire flow cross section is permanently available for damping the pressure surges. Furthermore, this flow cross section is located in the vicinity of the shut-off valve, where the pressure surges are produced during quick closure. Furthermore, the cylinder element is located in the interior of the flow channel, which helps to prevent the rectilinear propagation of the pressure surges and thus also helps to damp the latter.

BRIEF DESCRIPTION OF THE DRAWINGS

The invention will be explained in more detail with reference to an exemplary embodiment illustrated in the drawing, in which, purely schematically.

DETAILED DESCRIPTION OF PREFERRED EMBODIMENTS

Figure 1:
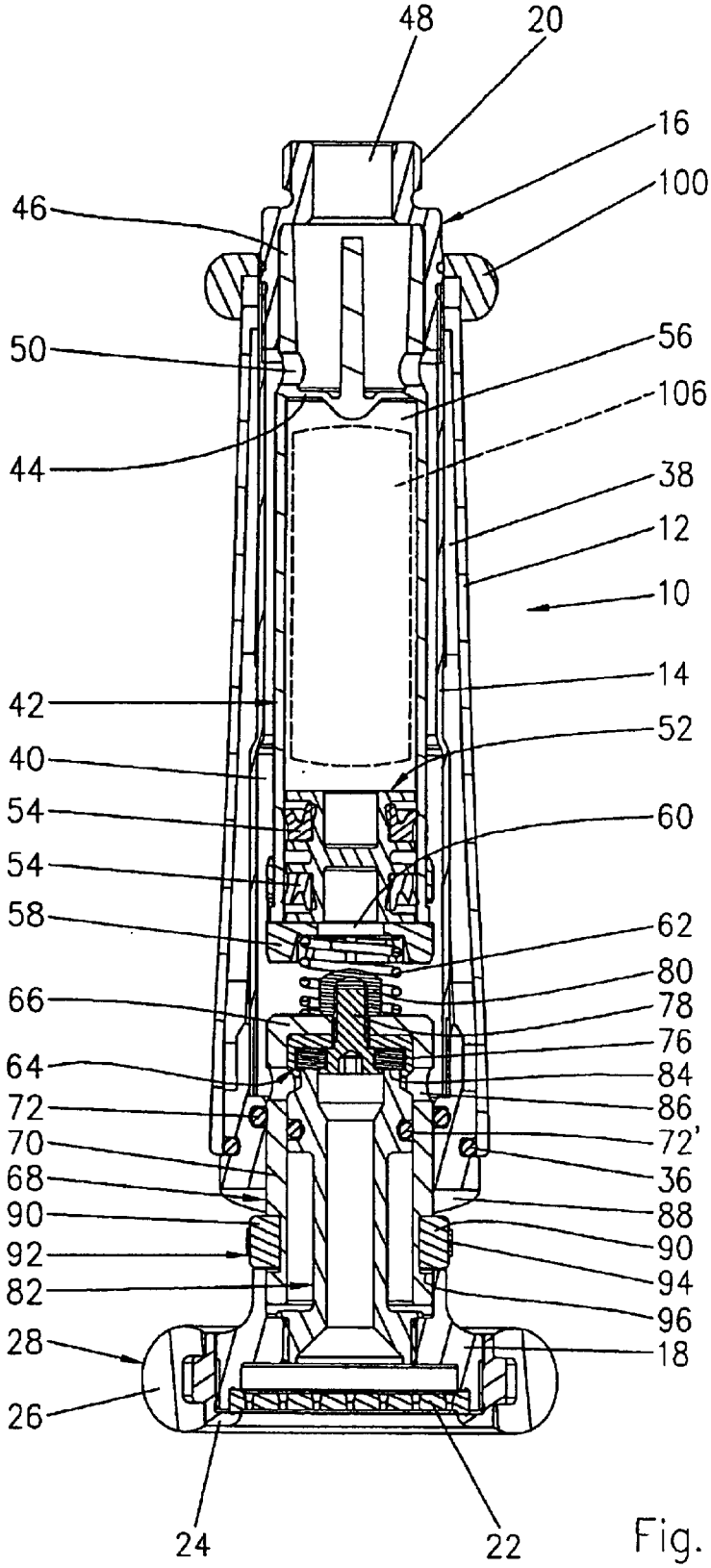
FIG. 1 shows in longitudinal section, a dishwashing sprayer according to the invention with the shut-off valve closed.

The sprayer which is shown in the figures, and is designed as a dishwashing sprayer, has a handle 10 with a tubular handle shell 12. Arranged concentrically in relation to the handle shell 12, and within the latter, is a connecting sleeve 14 which is screw-connected at one end to a connection nipple 16, and at the other end, to a sprayer-head element 18. In its free end region, the connection nipple 16 has a thread which forms a connection means 20 and is intended for the connection of a hose for supplying water. At the other end, a spray sieve 22 is inserted at the free end of the sprayer-head element 18. This spray sieve 22 is retained by means of an annular sieve holder 24 and has an elastomeric protection ring 26 engaging around its circumference. The sprayer-head element 18 with the spray sieve 22, the sieve holder 24 and protection ring 26 forms a sprayer head 28.

The connection nipple 16 has a stop shoulder (not shown in the figures) which extends over part of the circumference and interacts with the handle shell 12 at this end. At the other end, the handle shell, as can be gathered from FIG. 2 and 3, has, on its inside, a stop shoulder 32 which extends over part of the circumference and interacts with a mating shoulder 34 on the sprayer-head element 18. The handle shell 12 is thus secured in the axial direction and prevented from rotating in that it has a rotation-prevention tongue (not shown) which interacts with a rotation-prevention surface on the connection nipple 16. Inserted into a circumferential groove on the sprayer-head element 18 is an O-ring 36, against which the end region of the handle shell 12 butts in order to seal the cavity 38 which is formed for heat-insulation purposes between the handle shell 12 and the connecting sleeve 14.

The connecting sleeve 14 bounds a flow channel 40, through which the water is channeled from the connection nipple 16 to the sprayer head 18. Located in 25 this flow channel 40, concentrically in relation to the connection sleeve 14, is a cylinder element 42, of which the length, as measured in the axial direction, is approximately half the overall length of the dishwashing sprayer. The cylinder element 42 is closed on the connection-means side by a cylinder bottom 44, from which projects a hollow-cylindrical retaining flange 46 which is formed integrally with the cylinder element 42 and engages in a corresponding recess in the connection nipple 16. For securing the cylinder element 42 concentrically, use is made of ribs which project inward from the connecting sleeve 14 and run axially over approximately half the length of the cylinder element 42. The interior of the retaining flange 46 communicates, on the one hand, with the inlet opening 48 of the connection nipple 16 and, on the other hand, via radial apertures 50, with the annular flow channel 40 between the connecting sleeve 14 and the cylinder element 42.

A double-acting piston 52 is mounted in an axially freely moveable manner in the cylinder element 42. This piston 52, which is guided with sealing action on the cylinder element 42 by means of two axially spaced-apart sealing collars 54, bounds, together with the cylinder element 42, a gas volume 56, which is intended for damping pressure surges, as will be described at a later stage in the text.

Seated at the free end of the cylinder element 42 is a cylinder top 58, fastened on the cylinder element 42, for example, by means of a bayonet closure, which has a central aperture 60. Through this central aperture 60, the piston 52 has the pressure of the water acting on it at this end. At the other end, the pressure in the gas volume 56 acts on the piston 52.

A compression spring acting as a restoring spring 62 for a shut-off valve 64 is supported on the cylinder top 58, and at the other end, butts against the outside of a base 66 of a cup-like slide 68. The slide 68 is guided in an axially displaceable manner, by way of its casing 70, on the essentially hollow-cylindrical sprayer-head element 18. A first quad ring 72 is inserted into a circumferential groove which is arranged radially on the inside of the sprayer-head element 18, this quad ring interacts with the casing 70 in order to prevent water from passing out of the flow channel 40 between the sprayer-head element 18 and the slide 68.

On the inside of the slide 68, a cross-sectionally C-shaped, rotationally symmetrical seal holder 74, in which an annular-disc-like sealing element 76 is accommodated, butts against the slide base 66. Said sealing element is retained by means of a screw 78, which passes through the seal holder 74 and slide base 66 and onto which a cap nut 80 is screwed. The latter engages axially in the restoring spring 62, in order to avoid radial displacement. Moreover, the restoring spring 62 is also retained against radial displacement on the cylinder top 58, by the cylinder top 58 having a depression for the restoring spring 62.

The sealing element 76, which is fastened on the slide 68, forms a closure element of the shut-off valve 64, which interacts with an annular valve seat 84 formed at the free end of a valve-seat element 82. The more or less hollow-cylindrical valve-seat element 82, which is fastened on the sprayer-head element 18 by means of a screw connection, engages in the slide 68 from the side which is directed away from the slide base 66, and has a circumferential groove in which a second quad ring 72' is arranged. The latter butts against the inner wall of the casing 70 of the slide 68 and prevents water from passing out of the space which is bounded by the slide 68, the valve-seat element 82 and the sealing element 76. This space is connected to the flow channel 40 via radial throughflow openings 86 through the casing 70 of the slide 68.

As FIG. 1 shows, the otherwise rotationally symmetrical and hollow-cylindrical sprayer-head element 18 is provided with two diametrically opposite through-passage openings 88, which each have a fork element 90 of a hand lever 92 passing through them. The fork elements 90, which run parallel to one another, are mounted pivotably on the sprayer-head element 18 in their free end region by means of a bearing pin 94. Moreover, the fork elements 90, as can be gathered from FIG. 1, pass through outer carry-along recesses 96 on the casing 70 of the slide 68. This produces an operative connection, via the slide 68, between the hand lever 92 and the sealing element 76 of the shut-off valve 64, said sealing element serving as a closure element.

Figure 3:
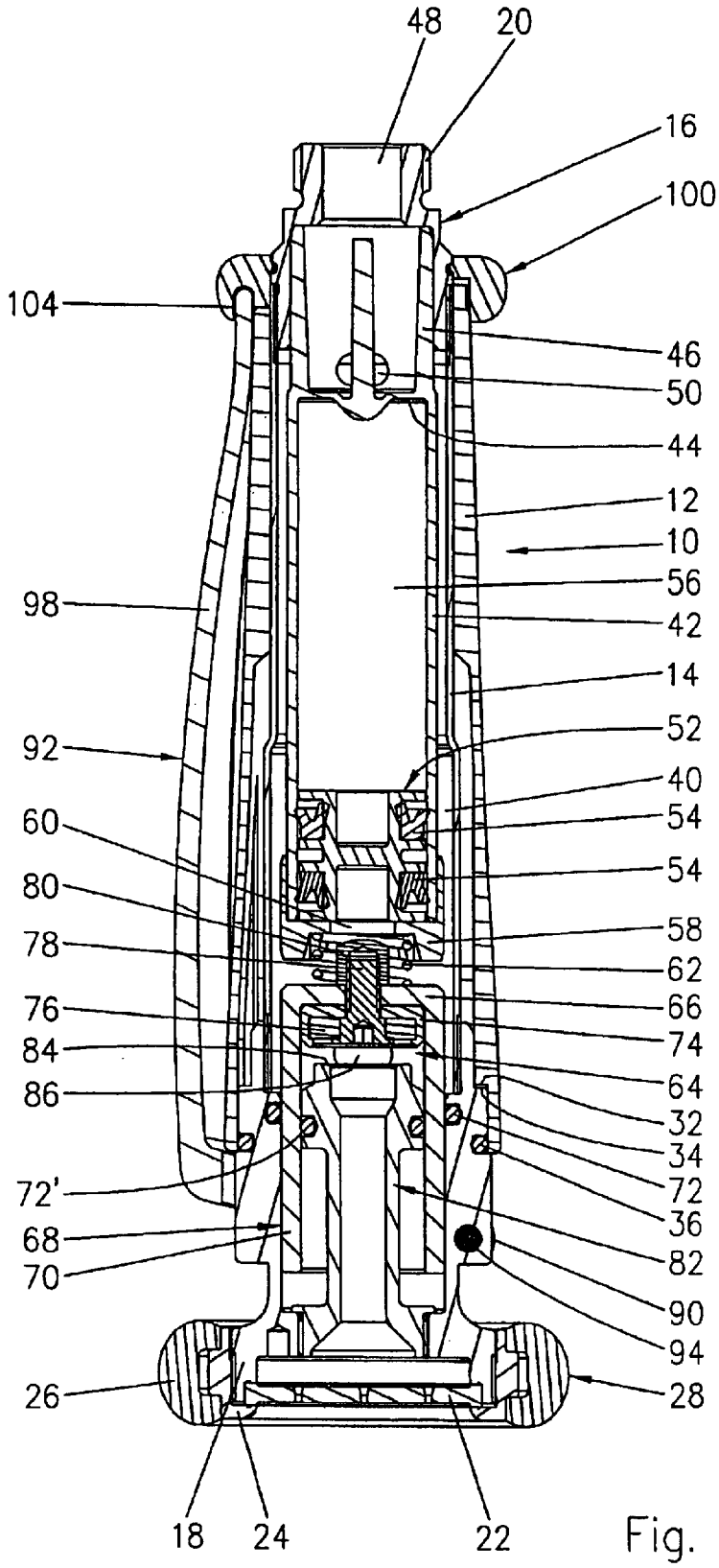
FIG. 3 shows, in a longitudinal section corresponding to FIG. 2, the dishwashing sprayer with the shut-off valve open.

When the shut-off valve 64 is open, as can be gathered from FIG. 3, the lever stem 98, which is connected integrally to the fork elements 90 and is angled in relation to the latter, butts more or less against the outside of the handle shell 12 and can be retained in this position, counter to the action of the restoring spring 62, by means of a retaining ring 100. The retaining ring 100 is mounted such that it can be rotated to a limited extent on the connection nipple 16, and it has a radial recess 102 with an undercut 104. In the corresponding rotary position of the retaining ring 100, the free end region of the lever stem 98 can be introduced into the radial recess 102, and by subsequent rotation of the retaining ring 100, the hand lever 92 is retained against pivoting in the undercut 104, as can be gathered from FIG. 3.

FIG. 1 uses dashed lines to indicate a balloon or bellows 106, which is located in the gas volume 56. If a balloon or bellows 106 is present, this is filled with a gas, preferably air, and ensures reliable functioning of the pressure-surge damping even if the seal between the piston 52 and cylinder element 42 should be damaged or no longer functional.

It is also conceivable to dispense with the piston 52 altogether and, in this case, to arrange a balloon or bellows 106 in the space which is bounded by the cylinder element 42.

Figure 2:
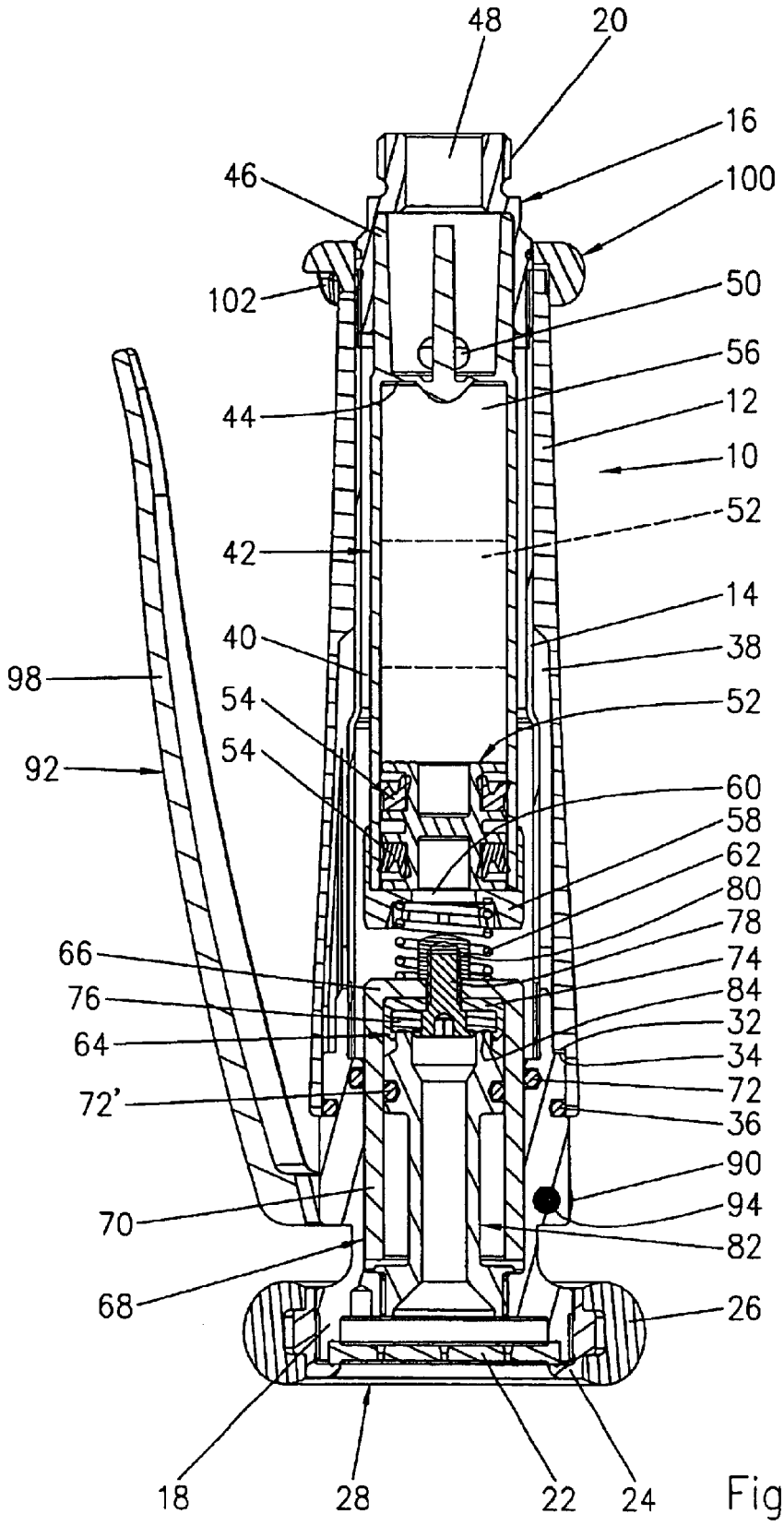
FIG. 2 shows, in a longitudinal section at right angles to that according to FIG. 1, the dishwashing sprayer likewise with the shut-off valve closed.

The functioning of the dishwashing sprayer which is shown 35 in the figures is as follows. With the shut-off valve 64 closed, as is shown in FIGS. 1 and 2, the water in the flow channel 40 is subjected to a pressure which corresponds to the static pressure of the water feed. The piston 52 here, as indicated by dashed lines in FIG. 2, is located in a position in which the gas in the gas volume 56 has been compressed to a pressure which corresponds to the water pressure.

If the hand lever is then pivoted in the direction of the handle shell 12 in order to open the shut-off valve 64, this pivoting movement causes the slide 68 to move in a translatory manner in the direction of the connection nipple 16, and counter to the force of the restoring spring 62, which results in the sealing element 76 lifting off from the valve seat 84, as shown in FIG. 3. Water thus flows from the inlet opening 48 of the connection nipple 16 into the retaining flange 46 and from there, through the two apertures 50, into the annular flow channel 40 and along the outside of the cylinder element 42 as far as the sprayer-head element 18. There, it flows through the throughflow openings 86 in the slide 68 to the shut-off valve 64 and from the latter, through the valve-seat element 82, to the outlet of the dishwashing sprayer, which is formed by the spray sieve 22. The flow of water causes the pressure in the flow channel 40 to drop, which results in the piston 52 moving, under the pressure of the gas, preferably air, in the gas volume 56, in the direction of its end position shown by solid lines in FIGS. 1 to 3. With a correspondingly selected pressure in the gas volume 56, the piston 52 can come into abutment against the cylinder top 58.

If the hand lever 92 is released in order to interrupt the flow of water, the shut-off valve 64 very quickly closes under the force of the restoring spring 62. The flow of water is thus interrupted abruptly, which, as a result of the water column being slowed down, leads to a pressure surge being produced. This pressure surge, then, is damped by the piston 52 moving in the direction of the cylinder bottom 44. If the central aperture 60 is formed to be as large as possible and is located in the vicinity of the shut-off valve 64, an optimum damping action is achieved. This is further assisted by the displacement volume which is bounded by the piston 52 and cylinder element 42 being formed to be as long as possible. Furthermore, the annular design of the flow channel 40 and also the apertures 50 and throughflow openings 86 subject the pressure surge to a damping action, with the result that, even if the shut-off valve is closed quickly, the supply line is subjected to pressure loading which is not much higher than that of the static feed-water pressure. Depending on the extent and duration of the pressure surge, the piston 52 can be moved, beyond the position indicated by dashed lines in FIG. 2, in the direction of the cylinder bottom 44. As soon as dynamic pressure then prevails again, it moves back into the dashed-line position.

In order to further optimize the damping action, the piston 52 is designed to be as lightweight as possible, which is made possible, for example, by being produced from plastic. The axial blind-hole-like recesses on the piston 52 which are shown in the figures likewise help to reduce the weight. Moreover, the cross-sectionally V-shaped sealing collars 54 ensure smooth movement of the piston 52 along with reliable sealing.

In the embodiment which is shown in FIGS. 1 to 3, the cylinder element 42 is open on the end side as a result of the central aperture 60 in the cylinder top 58. It is also conceivable, however, to provide radial apertures in the free end region, although the piston 52 has to be designed and/or supported such that these apertures are arranged on the water side of the piston 52.

The sprayer head according to the invention which is illustrated in the figures and has been described above, is arranged in a fixed manner in relation to the handle.

It is also conceivable, however, to arrange the sprayer head, together with the closure element of the shut-off valve, in an axially moveable manner, as is known, for example, from CH-A-647 165.

It is also conceivable for the shut-off valve to be of different design, for example as described in EP-A-0 656 503 and EP-A-0 704 252.

Furthermore, it is possible to dispense with a connecting sleeve 14. In this case, the connection nipple 16 and the sprayer head 28 are fastened on the handle shell. The provision of a connecting sleeve 14, however, has the advantage of good heat insulation between the possibly hot water in the flow channel 40 and the outer surface of the handle shell 12.

What is claimed is:

1. A sprayer for use with a supply line, the sprayer comprising:

a handle including an inlet end and an outlet end;

connection means arranged at the inlet end of the handle for the supply line;

a sprayer head and a shut-off valve, arranged at the outlet end of the handle, which can be actuated by a hand lever counter to a force of a restoring spring, including a flow channel which runs through the handle from the connection means to the shut-off valve;

means, arranged between the connection means and the shut-off valve, for damping pressure surges; and a cylinder element arranged in an interior of the flow channel, which is closed at an end which is directed toward the connection means and is open at an end region which is directed toward the shut-off valve, and in which a gas volume for damping the pressure surges is located.

2. The sprayer as claimed in claim 1, wherein the sprayer is a water sprayer, and wherein a double-acting piston is guided in a freely moveable manner in the cylinder element and, at one end, has a pressure of the water acting on it and at the other end, limits the gas volume.

3. The sprayer as claimed in claim 1, wherein a gas-filled balloon or bellows is arranged in the cylinder element.

4. The sprayer as claimed in claim 1, wherein the connection means are formed on a connection nipple, on which the cylinder element is fastened.

5. The sprayer as claimed in claim 2, wherein the connection means are formed on a connection nipple, on which the cylinder element is fastened.

6. The sprayer as claimed in claim 3, wherein the connection means are formed on a connection nipple, on which the cylinder element is fastened.

7. The sprayer as claimed in claim 1, wherein the restoring spring is supported at one end on the cylinder element and, at the other end, on a slide, on which a closure element of the shut-off valve is arranged and on which the hand lever acts.

8. The sprayer as claimed in claim 7, wherein the slide is of cup-like design, a valve-seat element which is arranged in a fixed manner in relation to the handle projects into the slide, the valve-seat element interacts with the closure element arranged in the interior of the slide, and the slide has apertures which communicate with the flow channel.

9. The sprayer as claimed in claim 8, wherein the slide is mounted in the sprayer head.

10. The sprayer as claimed in claim 1, wherein arranged between the handle and cylinder element is a connecting sleeve, which bounds the flow channel and on which the connection means and the sprayer head are fastened.

* * * * *